US005230541A

United States Patent [19]

Nowak

[11] Patent Number: 5,230,541

[45] Date of Patent: Jul. 27, 1993

[54] CABINET FASTENER

[75] Inventor: Ralph M. Nowak, Marblehead, Mass.

[73] Assignee: Kiddie Products, Inc., Avon, Mass.

[21] Appl. No.: 923,031

[22] Filed: Jul. 31, 1992

[51] Int. Cl.[5] ..... E05C 19/18

[52] U.S. Cl. ..... 292/288; 292/307 R; 24/16 PB

[58] Field of Search ..... 292/288, 264, 307 R, 292/318, 321, 282, DIG. 16; 24/16 PB, 17 AP, 17 B, 30.5 P

[56] References Cited

U.S. PATENT DOCUMENTS

| | | | |
|---|---|---|---|
| 2,884,214 | 4/1959 | Wrobel | 24/16 PB |
| 3,165,801 | 1/1965 | Stansbury, Jr. et al. . | |
| 3,229,998 | 1/1966 | Pennington . | |
| 3,942,750 | 3/1976 | Noorily | 24/16 PB X |
| 4,022,503 | 5/1977 | Bey | 292/288 X |
| 4,458,385 | 7/1984 | Espinoza | 24/16 PB |
| 4,574,434 | 3/1986 | Shupe et al. . | |
| 4,609,171 | 9/1986 | Matsui | 24/16 PB X |
| 4,658,478 | 4/1987 | Paradis . | |
| 4,862,561 | 9/1989 | Lichtenberg | 24/16 PB |
| 4,882,813 | 11/1989 | Nakamura . | |
| 4,958,414 | 9/1990 | Benoit . | |
| 5,121,524 | 6/1992 | Mortensen | 24/16 PB |
| 5,123,686 | 6/1992 | Wenk | 24/16 PB X |

OTHER PUBLICATIONS

Kiddie Products, Inc., d/b/a The First Years, copies of package front (written product shown) and back for Product 3312, Cabinet Safety Lock; package copyright 1990.

*Primary Examiner*—Rodney M. Lindsey
*Attorney, Agent, or Firm*—Fish & Richardson

[57] ABSTRACT

A fastener for cabinets is provided, which can be easily adjusted to securely fasten together the paired handles of a cabinet, regardless of their spacing. The cabinet fastener includes a housing having, on one side, a latch opening of predetermined width, a finger opening disposed adjacent the latch opening and a stop disposed between the latch opening and the finger opening. One end of a flexible, elongated band having two ends passes through an opening in the housing on the side opposite the side having the latch opening, and is adjustably retained in said housing. A resilient primary latch is disposed at the opposite end of the band, which has a normal width greater than the width of the latch opening and is adapted to resiliently deflect to a smaller width to fit through the latch opening and spring back so that a portion of the primary latch protrudes into the finger opening and engages the stop, preventing the primary latch from being pulled from the latch opening.

8 Claims, 3 Drawing Sheets

CABINET FASTENER

BACKGROUND OF THE INVENTION

This invention relates to child resistant fasteners for securing cabinet doors.

In households in which there are small children, it is desirable to prevent the children from accessing drawers and cabinets containing dangerous instrumentalities, e.g., knives and poisonous household chemicals.

Many "child-proof" drawer and cabinet fasteners have been developed, with the objective of making the fastener both difficult for children to open and easy for adults to open and close. Other desired qualities for a child-proof fastener are durability, low cost and ease of manufacture.

Cabinets typically contain a number of paired doors, each door having a handle near the area where the doors meet. The spacing between these handles may vary for different cabinets. Additionally, for cabinets in which the handles comprise knobs, in order to securely close the cabinet, it is necessary that the handles be tightly fastened together. A fastener for cabinet handles comprising a rigid U-shaped plastic member, which may be positioned through or around the handles, and a slider bar which slides onto the free ends of the member and down the member to secure the lock member in place around the handles, is available from Kiddie Products, Inc., d/b/a The First Years, as Cabinet Safety Lock, Product No. 3312; this fastener requires moving the slider bar past the free end of one leg of the U-shaped member to remove the fastener from the cabinet and then to readjust the slider bar when fastening the cabinet.

SUMMARY OF THE INVENTION

The present invention features a fastener for cabinets, which can be easily adjusted to securely fasten together the paired handles of a cabinet, regardless of their spacing and style. The fasteners of the invention can be adjusted to any desired size, e.g., to fit a particular cabinet, and then removed and refastened without adjusting the size.

In general, the invention features a cabinet fastener including a housing having, a latch opening of predetermined width on one side, a finger opening on a side adjacent and angularly disposed relative to said one side and a stop disposed between the latch opening and the finger opening. One end of a flexible, elongated band having two ends passes through an opening in the housing on the side opposite the side having the latch opening, and is adjustably retained in the housing. A resilient primary latch is disposed at the opposite end of the band, which has a normal width, at its widest point, greater than the width of the latch opening and is adapted to resiliently deflect to a smaller width to fit through the latch opening and spring back so that a portion of the primary latch protrudes into the finger opening. The primary latch engages and is biased against the stop, preventing the primary latch from being pulled from the latch opening.

In preferred embodiments, the fastener further includes a resilient secondary latch disposed adjacent the primary latch on the band. The secondary latch is movable between an open position, in which the latch member can be disengaged from the stop, and a closed position in which the secondary latch fits across the latch opening to secure the primary latch against the stop and prevent deflection and release of the primary latch.

In other preferred embodiments, the band is a toothed band, and a pawl disposed in the housing for engagement with and retention of the toothed band prevents the band from being pulled out of the housing, but allows the band to be pushed further into the housing. The pawl preferably includes a pivotally mounted resilient V-shaped member, having a first leg which normally rests against an inner wall of the housing and a second leg which terminates in a notch dimensioned to engage a tooth of the toothed band. The pawl preferably further includes a release member extending from the second leg at an acute angle with respect to the end of the leg, and the housing includes a slot communicating with the release member. An elongated instrument (e.g. a screwdriver) can be inserted through this slot to resiliently deflect the release member and second leg towards the first leg and disengage the toothed band from the pawl, enabling the band to be removed partially or entirely from the housing. The teeth of the toothed band are preferably approximately square.

In other preferred embodiments, the primary latch includes a hook-shaped portion which includes a U-shaped member having a fixed end extending from the band and a free end, and a resilient member disposed at an acute angle relative to the free end of the U-shaped member and dimensioned to engage and slide against the fixed end when the free end is deflected. Preferably, the free end at its upper end is provided with a recess dimensioned to engage the stop, and the recess and the facing portion of the stop have corresponding downwardly inclined surfaces to provide increased resistance to opening the primary latch.

Other features and advantages of the invention will be apparent from the Description of the Preferred Embodiments, together with the Drawings and the claims.

DESCRIPTION OF THE PREFERRED EMBODIMENTS

Figure 1:
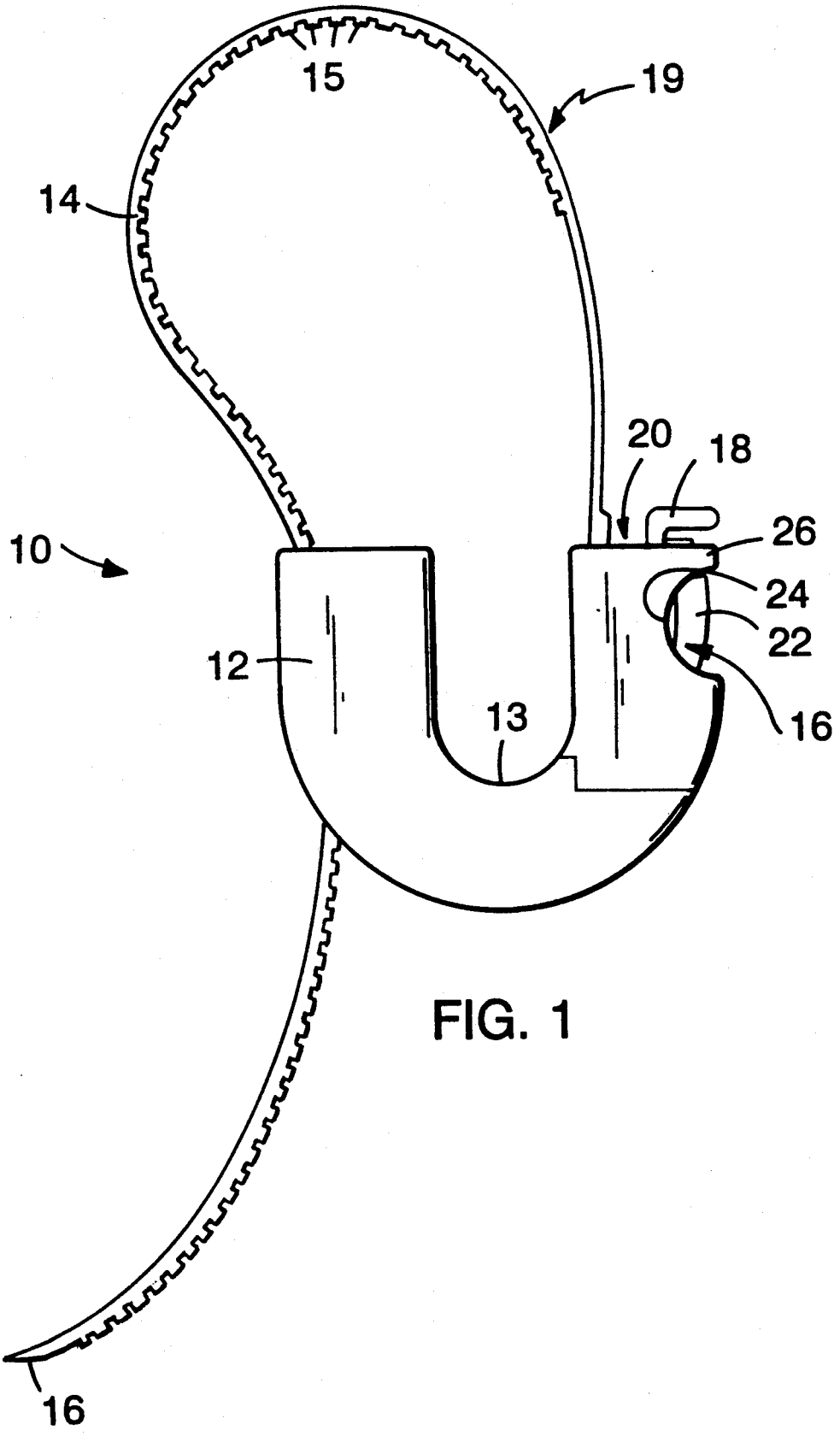
FIG. 1 shows a side view of a cabinet fastener according to a preferred embodiment of the invention.
Figure 2:
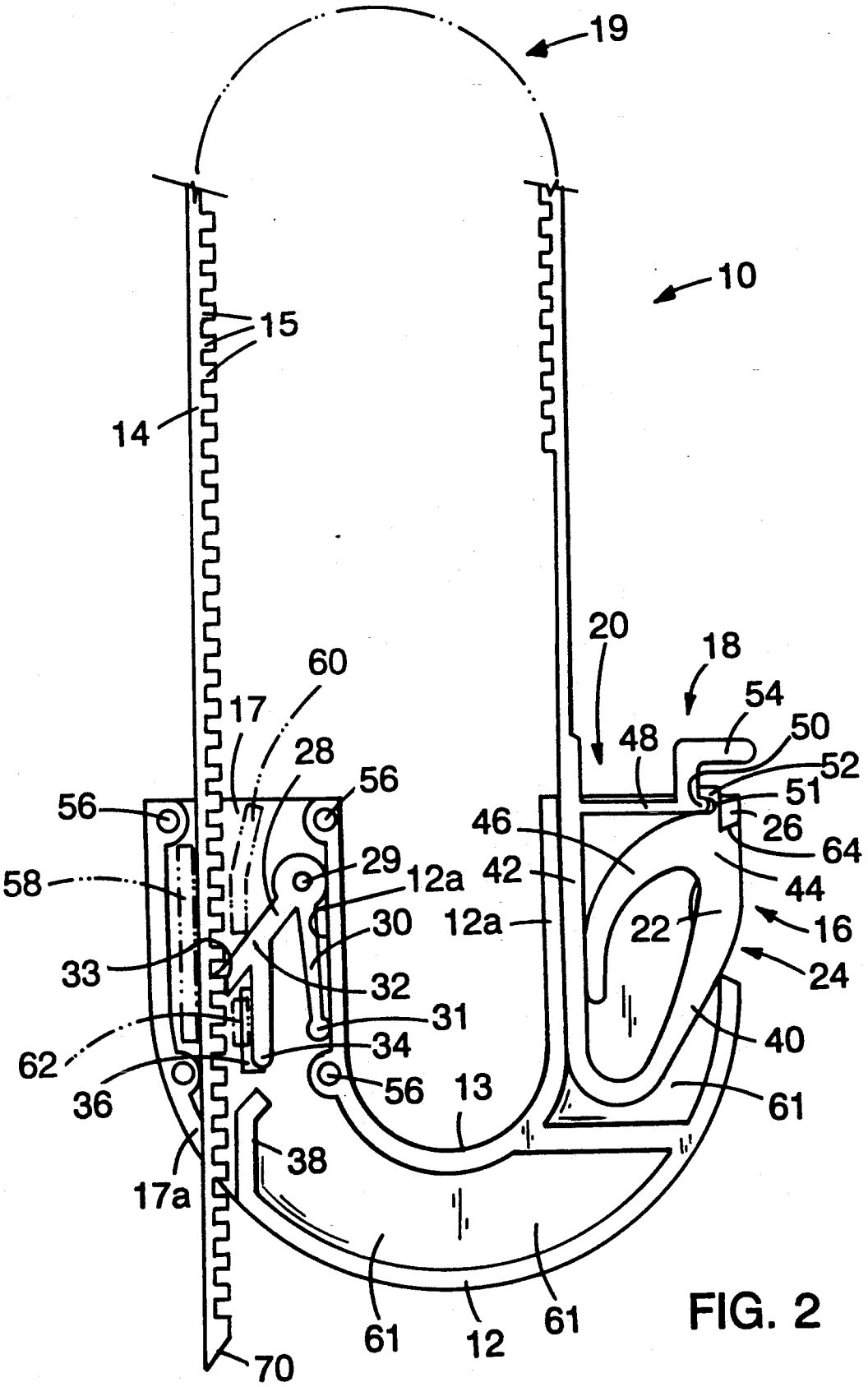
FIG. 2 shows an enlarged side view of the cabinet fastener shown in FIG. 1, with the cover of the housing removed.

Referring to FIGS. 1 and 2, a cabinet fastener 10 according to a preferred embodiment of the invention is shown. Cabinet fastener 10 includes a housing 12 having a cabinet handle engaging arcuate recess 13 generally centrally located on the inside of the housing. Housing 12 is preferably a durable, rigid plastic, e.g., ABS plastic. Housing 12 preferably is formed from at least two parts, preferably a base (shown in FIGS. 2–5) and a cover (shown only in FIG. 1), to enable pawl 28 to be easily inserted into the housing during manufacture. The parts of the housing may be assembled by inserting posts on one half (not shown) into apertures 56 in the other half, and then sonically welding the parts of the housing together around their periphery, or by other means, such as adhesive or screws. Housing 12 is preferably approximately U-shaped, as shown, to fit around a cabinet handle.

The fastener 10 also includes a toothed flexible band 14 having a plurality of approximately square teeth 15, one end 70 of which is tapered and passes through entrance opening 17 and exit opening 17*a* in a side of housing 12, and the other end of which is inserted into latch opening 20 in the opposite side of the housing and secured therein by primary latch 16 and secondary latch 18, forming a loop 19 of adjustable length.

As shown in FIG. 2, toothed band 14 is adjustably retained in housing 12 by pawl 28, pivotally mounted on pivot 29. Toothed band 14 is preferably of a flexible resilient plastic material, more preferably nylon, while pawl 28 is preferably of a resilient, durable plastic, e.g., CELCON plastic, a plastic based on an acetal resin, commercially available from Celanese Corporation. Pawl 28 comprises a V-shaped member having a first leg 30 which terminates in an enlarged portion 31, normally resting against wall 12*a* of housing 12, and a second leg 32, disposed at an angle of approximately 50 degrees with respect to first leg 30, which terminates in a notch 33. First leg 20 and second leg 32 extend from the pivot toward exit opening 17*a*. Notch 33 is shaped to engage the teeth of the toothed band, and prevent the band from being pulled out of the housing through entrance opening 17 while permitting the band to be freely moved in the other direction through exit opening 17*a* by the deflection of the resilient band. The toothed band is secured against the pawl by support member 58 on the housing cover (shown in broken lines in FIG. 2). A release member 34 extends from second leg 32 at an angle of approximately 40 degrees with respect to the end of second leg 32. Release slot 36 in housing 12 allows the user of the fastener to insert a screwdriver or the like into the slot and deflect release member 34 towards first leg 30, causing notch 33 to disengage from teeth 15 and allows the loop of band 14 to be lengthened, or the band to be removed entirely from the housing. The position of release member 34 is limited, so that the release member is in a position in which it can be deflected by the screwdriver, by positioning member 62 on the housing cover (shown in broken lines in FIG. 2). Guide member 38 extends into the interior 61 of housing 12, to guide toothed band 14 through the housing and out through opening 17*a*. Toothed band 14 is also guided by guide member 60 on the housing cover (shown in broken lines in FIG. 2).

Primary latch 16, disposed at the opposite end of and integral with toothed band 14, has a normal width, at its widest point, greater than the width of latch opening 20. Primary latch 16 has a hook-shaped portion which comprises a U-shaped member 40 having a fixed end 42 integral with and extending from the toothed band and a free end 44, a portion 22 of which protrudes through a finger opening 24 in the housing, on a side adjacent and angularly disposed at a right angle relative to the side of the housing containing the latch opening, when the latch is engaged. The primary latch at the juncture of fixed and free ends 42 and 44 is narrower than the width of latch opening 20 to facilitate insertion of the primary latch therein. A resilient extension 46 of the free end is disposed at an acute angle relative to free end 44, for sliding engagement against fixed end 42 when free end 44 is deflected, e.g., by a user applying thumb pressure to portion 22 through finger opening 24 or by the primary latch being pressed down into latch opening 20. Thus, the primary latch is adapted to resiliently deflect to a smaller width to fit through the latch opening and spring back so that portion 22 protrudes into the finger opening and is resiliently biased against stop 26, preventing the primary latch from being pulled from the latch opening. The free end 44 at its upper end is provided with a recess or notch 64 to engage stop 26 positioned between the latch and finger opening 20, 24; the notch and the facing portion of stop 26 slope downwardly to provide resistance, in combination with the biasing action of extension 46, to opening of the latch.

Although cabinet latch 10 is securely fastened and difficult for a small child to access using primary latch 16 alone, the cabinet latch preferably also includes, as shown in FIG. 2, secondary latch 18. Secondary latch 18 includes bracing member 48, which extends straight across latch opening 20, terminating in rib 50 which fits into recess 51 and engages shoulder 52 of primary latch 16. Secondary latch 18 further includes actuation member 54, which is offset above the bracing member and which enables the user to press the secondary latch into its engaged position. The secondary latch may be disengaged by pressing upward on actuation member 54 to deflect rib 50 out of recess 51 and past shoulder 52. The bracing member is both straight and rigid, preventing deflection and resulting release of the primary latch.

The cabinet latch is initially mounted by sliding the toothed band through or around the cabinet handles (depending upon whether they are U-shaped handles or knobs), inserting the end of the toothed band through the entrance opening and out through the exit opening in the housing, and pushing the band further into the housing until the toothed band is tightly fastened around the handles. The latch can then be removed and refastened around that cabinet, or any other having the same handle type and spacing, by releasing the secondary and primary latches, without readjusting the length of the loop formed by the band. If the latch is to be used on a cabinet having handles which are further apart, the loop may be lengthed by releasing the pawl as described hereinabove, while if the latch is to be used on a cabinet having handles which are closer together the loop may be shortened by passing the band further through the housing.

Figure 3:
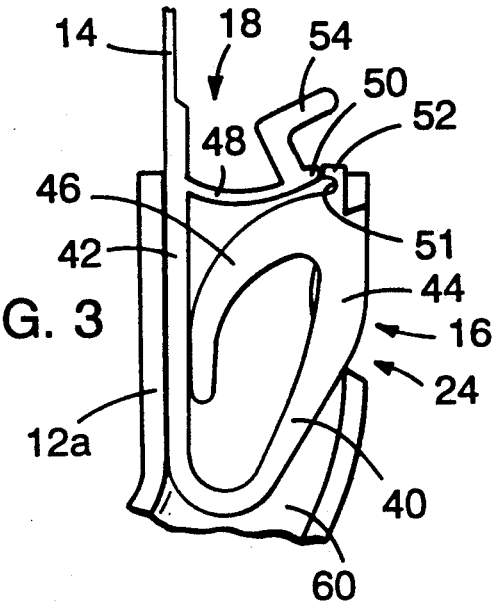
FIGS. 3, 4 and 5 show fragmentary, enlarged side views of the dual-action latch of the fastener of FIG. 1, in various stages of being opened. As in FIG. 2, the cover of the housing is removed.
Figure 4:
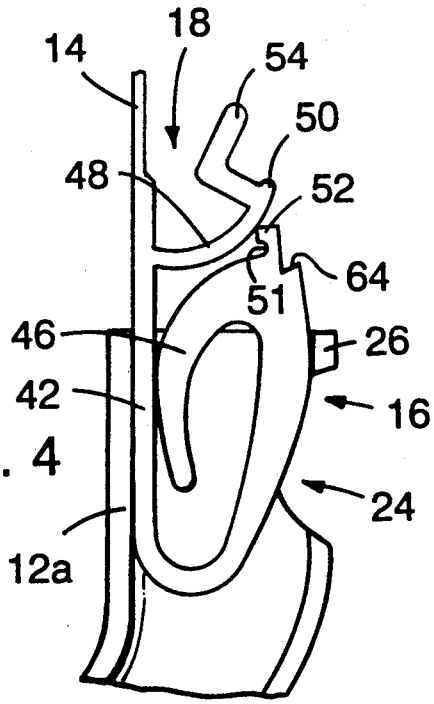
Figure 5:
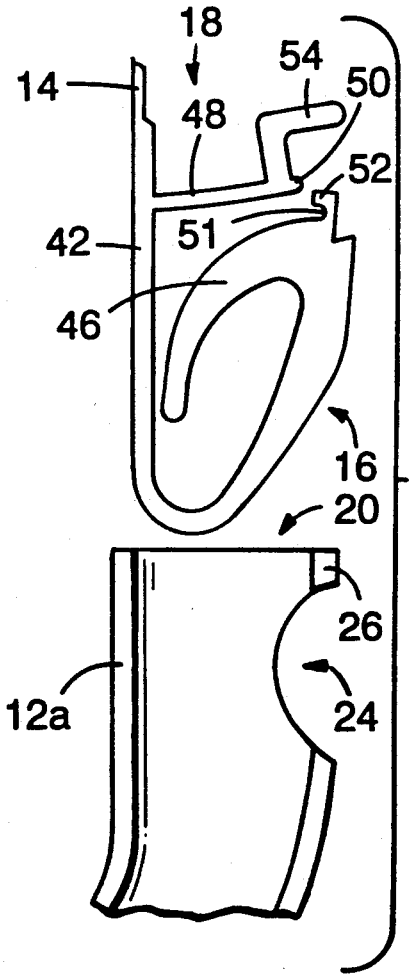

The removal of primary latch 16 and secondary latch 18 is shown in detail in FIGS. 3, 4 and 5. In FIG. 3, primary latch 16 is fully engaged, while secondary latch 18 is in a partially disengaged position. To move the secondary latch 18 from its fully engaged position, shown in FIGS. 1 and 2, to the position shown in FIG. 3, flexible bracing member 48 is flexed by pressing upward on actuation member 54, disengaging rib 50 from recess 51 and shoulder 52. FIG. 4 shows primary latch 16 in the position in which resilient member 46 has slid down against fixed end 42, aided by stop 26 which provides resistance against portion 22, urging resilient member 46 against the fixed end. In this manner, the width of primary latch 16 is reduced so that the latch can be removed from or inserted into latch opening 20. In FIG. 5, the latch is shown completely removed from the housing. To secure the latch the sequence is reversed until primary latch 16 is fully within the housing, with notch 64 engaging stop 26; the secondary latch is then engaged by pressing down on member 54, forcing rib 50 past shoulder 52 and into recess 51.

While preferred embodiments have been described above, other variations and modifications are within the scope of the following claims.

I claim:

1. A cabinet fastener comprising a housing having a centrally positioned cabinet handle engaging portion, a latch opening of predetermined width on one side of said handle engaging portion, a finger opening on a portion of said housing spaced outwardly from said handle engaging portion, adjacent and angularly disposed relative to said one side, and a stop disposed between said latch opening and said finger opening;

a flexible, elongated band having two ends, one end passing through an opening in said housing on the other side of said handle engaging portion, opposite said one side, and being adjustably retained in said housing; and a resilient primary latch, disposed at the opposite end of said band, having a normal width at its widest point greater than said width of said latch opening and adapted to resiliently deflect to a smaller width to fit through said latch opening and spring back so that a portion of said primary latch protrudes into said finger opening and engages and is biased against said stop, preventing said primary latch from being pulled from said latch opening.

2. A fastener of claim 1 further comprising a resilient secondary latch disposed between said primary latch and said band, movable between an open position, in which said primary latch portion can be disengaged from said stop, and a closed position in which said secondary latch fits across the latch opening to secure said primary latch portion against said stop and prevent deflection of said portion of said primary latch.

3. A fastener of claim 1 wherein said band is a toothed band, and a pawl disposed in said housing for adjustable engagement and retention of said toothed band in said housing prevents said band from being pulled out of said housing, but allows said band to be pushed further into said housing.

4. The fastener of claim 3 wherein said pawl comprises a pivotally mounted resilient V-shaped member, having a first leg which normally rests against an inner wall of said housing and a second leg which terminates in a notch dimensioned to engage a tooth of said toothed band.

5. A fastener of claim 4 wherein said pawl has a release member extending from said second leg at an acute angle and said housing includes a slot communicating with the release member, through which an elongated instrument can be inserted to resiliently deflect the release member and second leg towards the first leg and disengage the toothed band from the pawl, enabling the band to be removed partially or entirely from the housing.

6. The fastener of claim 1, 2 or 3 wherein said primary latch comprises a hook-shaped portion comprising a U-shaped member having a fixed end extending from said band and a free end, and a resilient member disposed at an acute angle relative to the free end of said U-shaped member and dimensioned to engage and slide against said fixed end when said free end is deflected.

7. The fastener of claim 6 wherein said free end at its upper end is provided with a recess dimensioned to engage said stop.

8. The fastener of claim 7 wherein said recess and the facing portion of said stop have corresponding downwardly inclined surfaces to provide increased resistance to opening said primary latch.

* * * * *